United States Patent [19]

Gordon et al.

[11] Patent Number: 4,486,044

[45] Date of Patent: Dec. 4, 1984

[54] APPARATUS FOR SUPPORTING AND TRANSPORTING A GAS CYLINDER

[75] Inventors: Harris K. Gordon, Cheltenham, Pa.; Howard Myers, Whippany, N.J.

[73] Assignee: Tank-Tote Co., Cheltenham, Pa.

[21] Appl. No.: 405,894

[22] Filed: Aug. 6, 1982

[51] Int. Cl.[3] ..... B65D 61/00

[52] U.S. Cl. ..... 294/31.2; 150/52 R; 220/69; 220/70.1; 220/401; 220/449; 224/202; 294/142; 294/146; 294/165; 248/89; 248/154; 248/313

[58] Field of Search ..... 220/69, 401, 70.1, 449; 431/344; 169/30; 294/146, 31.2, 165, 142; 248/154, 89, 313; 224/202, 42.4, 42.38; 150/52 R

[56] References Cited

U.S. PATENT DOCUMENTS

| | | | |
|---|---|---|---|
| 1,058,900 | 4/1913 | Ploch | 431/344 X |
| 1,288,839 | 12/1918 | Conrad et al. | 224/42.38 X |
| 2,499,672 | 3/1950 | Nurkiewicz | 169/30 X |
| 2,615,238 | 10/1952 | Highwood | 248/154 X |
| 2,682,886 | 7/1954 | Paxton | 248/154 X |
| 2,711,201 | 6/1955 | Hotz | 294/146 X |
| 2,725,208 | 11/1955 | Bouq | 248/89 |
| 2,791,255 | 5/1957 | Ogden | 294/146 X |
| 3,240,407 | 3/1966 | Boak | 224/42.4 X |
| 3,942,636 | 3/1976 | Matsuyama et al. | 150/52 R X |
| 4,109,692 | 8/1978 | Brown | 150/52 R |
| 4,294,481 | 10/1981 | Pearl | 294/146 |

*Primary Examiner*—Allan N. Shoap

*Attorney, Agent, or Firm*—Robert C. Podwil

[57] ABSTRACT

A supporting and transporting apparatus for a gas cylinder comprises a base, supporting and clamping structure to removably secure a gas cylinder to the apparatus, and a jacket associated with the supporting and clamping structure and with the cylinder so as to provide a convenient means for storing accessories and tools to be used with the cylinder.

7 Claims, 5 Drawing Figures

FIG. 2
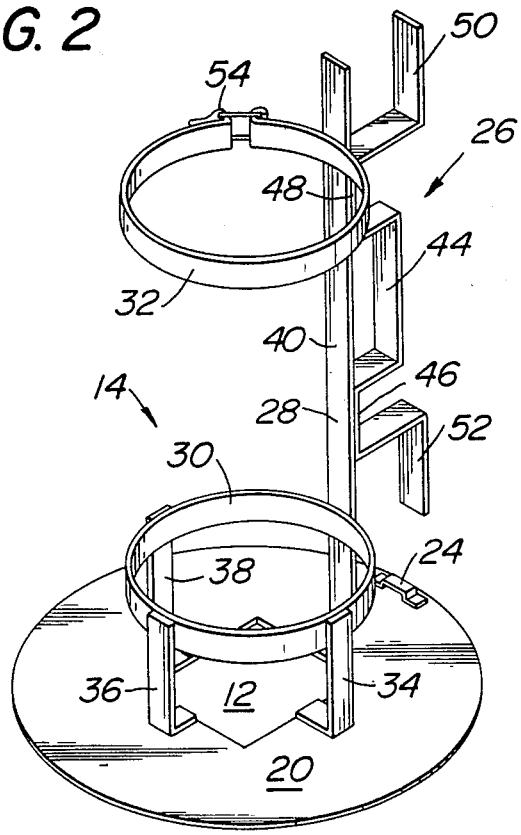
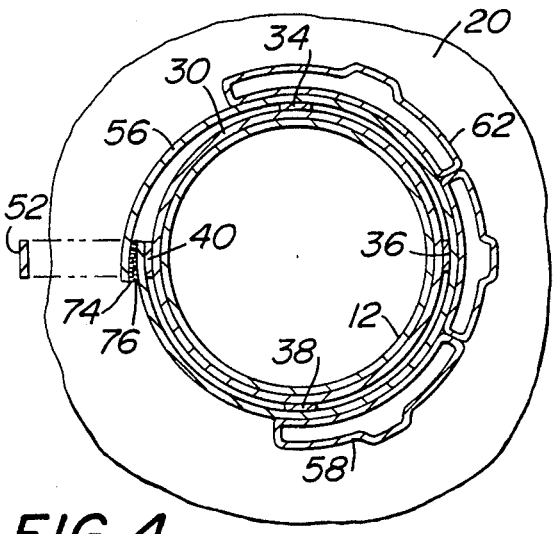
FIG. 4
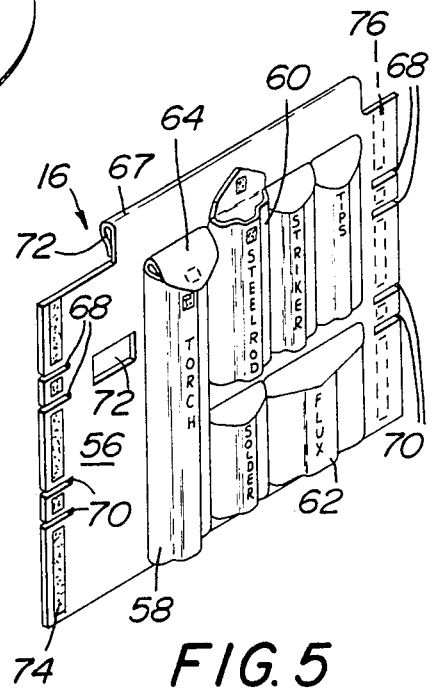
FIG. 5

APPARATUS FOR SUPPORTING AND TRANSPORTING A GAS CYLINDER

BACKGROUND OF THE INVENTION

This invention relates to apparatus for supporting and transporting a gas cylinder or the like. More particularly, this invention relates to apparatus for supporting and transporting a gas cylinder, wherein a simple and highly portable support is provided for the cylinder, and, in association with the support, there is also provided a means for retaining in association with the cylinder and support accessories and other materials to be used with the cylinder.

Those in the plumbing, air conditioning and heating trades often use acetylene or other bottled gases for soldering, brazing or welding. Typically, the gases are provided in storage tanks or cylinders, which, because they are pressurized, must be of substantial construction. Such cylinders are often heavy and unwieldy. Because of their shape, the cylinders are rather mechanically unstable. When placed on end, they tend to fall, frequently damaging surrounding walls, furniture or fixtures, as well as their own hoses, fittings and regulators. Cylinders of the sizes most frequently used are not easily carried, and they are particularly difficult to carry when associated, as they often are, with long lengths of hose and accessories.

The difficulties with conventional cylinders are not entirely due to the characteristics of the cylinders themselves. Soldering operations (or, in other uses of such cylinders, brazing and welding operations) involve the use of torches and associated materials such as solder, flux, strikers, specialized tips and brushes. All of these must be carried to a job site and readily accessible to the user.

The present invention is directed to mechanically simple and lightweight apparatus for supporting and transporting a gas cylinder, as well as accessories for use in association with the cylinder. In one of its aspects, the present invention is directed to a unique support for a gas cylinder, and in another aspect, to a novel jacket which cooperates with the support to provide convenient and secure storage for accessories to be used with the cylinder.

Apparatus for supporting or transporting gas cylinders has heretofore been proposed. For example, applicant is aware of U.S. Pat. No. 2,615,238, issued Oct. 28, 1952, to Highwood and U.S. Pat. No. 4,294,481, issued Oct. 13, 1981, to Pearl. Such apparatus, however, does not provide the simplicity and efficiency of the applicant's structure, nor does it contemplate the cooperative relationship between the applicant's novel support and the equipment storage means associated with the support.

SUMMARY OF THE INVENTION

The foregoing and other objects of the invention are realized, in a presently preferred form of the invention, by apparatus comprising a support having a base, cylinder retaining means coupled to the base and extending upwardly from the base, and equipment storage means selectively engageable with the cylinder retaining means. The equipment storage means, in the presently preferred form of the invention, comprises a jacket fitted to the support and the cylinder, and providing a number of pockets for receiving welding tools and the like. The cylinder retaining means, in the presently preferred form of the invention, takes the form of a band which encircles the cylinder, and clamps it to the support. The support provides a handle for hand-carrying the apparatus (including the cylinder), and provides a means for affixing to the apparatus a carrying strap, making possible hands-free carrying of the apparatus.

BRIEF DESCRIPTION OF THE DRAWINGS

FIG. 2 is a perspective view of a cylinder support in accordance with the invention;

FIG. 4 is a cross-sectional view taken along the line 4—4 in FIG. 1; and FIG. 5 is a perspective view of a jacket, which provides the unique equipment storage means in accordance with the invention.

DETAILED DESCRIPTION

Figure 1:
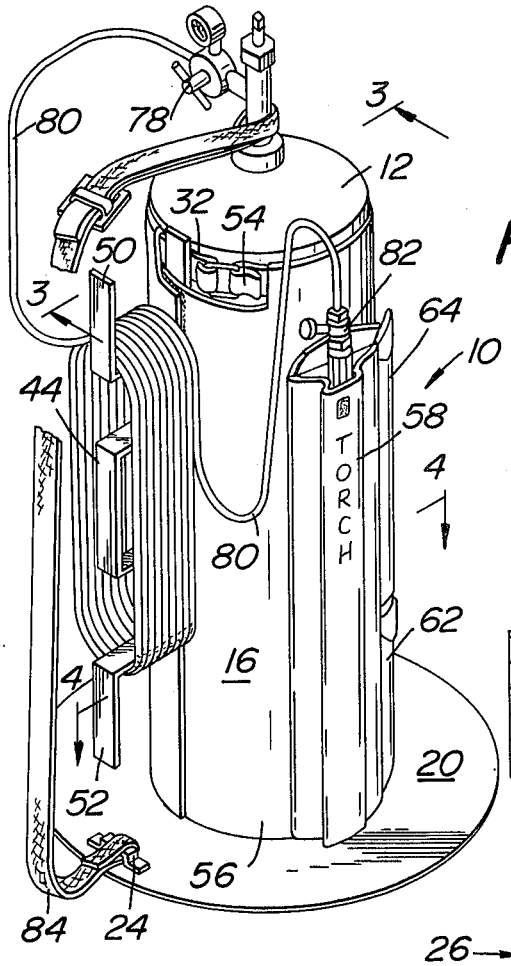
FIG. 1 is a perspective view of apparatus in accordance with the invention.

Referring now to the drawings in detail, wherein like reference numerals indicate like elements, there is seen in FIG. 1 an apparatus designated generally by the reference numeral 10 for supporting and transporting a gas cylinder 12.

Referring to FIGS. 1 and 2, the apparatus 10 comprises a support, designated generally by the reference numeral 14, and an equipment storage means, in the form of a jacket designated generally by the reference numeral 16, and perhaps best seen in FIG. 5. The jacket 16, when operatively disposed, encircles the cylinder 12, and is provided with a plurality of pockets or receptacles 18, especially adapted for ready storage of tools apparatus and accessories of the kinds used in association with the cylinder 12 when the cylinder is used in welding, brazing or soldering operations.

Referring now to FIG. 2, the support 14 will now be described in greater detail.

The support 14 comprises a ground or floor-engaging base 20. The base 20, it will be understood, is made wide enough to provide a stable platform for the cylinder 12, and to protect against accidental tipping or upset of the apparatus 10 during use or storage. If desired, the base 20 may be provided with a cut-out opening 22, as shown, for lightness. The base 20 may also be provided with a bracket 24, the purpose of which will be described below.

Figure 3:
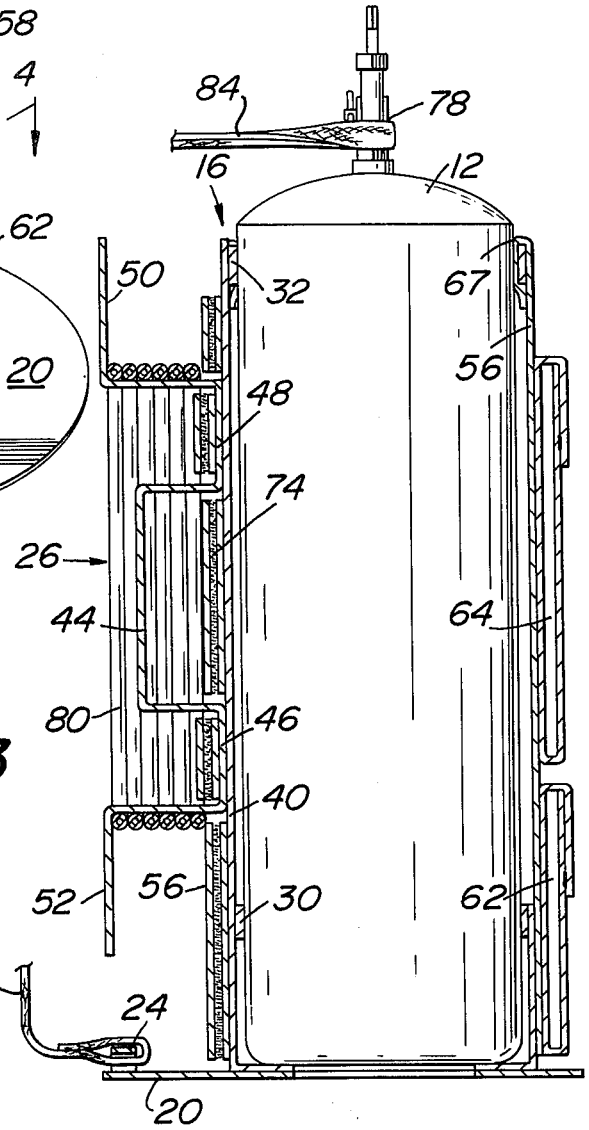
FIG. 3. is a cross-sectional view, taken along the line 3—3 in FIG. 1.

Extending upwardly from the base 20 is a structure, designated generally by the reference numeral 26, for supporting and retaining a cylinder 12 in association with the apparatus 10. The structure 26 consists of an upright support member 28, to which cylinder-encircling band members 30 and 32 are affixed by welding or other suitable fabrication techniques. In the illustrated form of the invention, which represents the best mode presently contemplated for carrying the invention into effect, the lower band member 30 is supported in part by circumferentially spaced brackets 34, 36 and 38, affixed to the base 20 and to the band member 30 by welding or other suitable techniques. The brackets 34, 36 and 38, as well as the lower portion of the upright support number 28 provide, in effect, a structural support for the band member 30, and the band member 30 provides, as is perhaps best seen in FIG. 3, a receptacle for the lower end of the gas cylinder 20.

The upright support member 28 also provides a handle for carrying the apparatus 10 and a convenient bracket for storing welding hose. In this regard, referring again to FIGS. 1 and 2 and also to FIG. 3, it will be seen that the upright support member 28 comprises a first strip-like element, of bar stock or the like, and a second strip-like element 42, affixed to the first strip-like element 40, as by spot welding or other suitable techniques. The second strip-like element 42, as is perhaps best seen in FIG. 3, has a sinuous configuration, characterized by a central offset portion 44, which defines a handle portion; a pair of portions 46 and 48 disposed on either side of the central offset portion 44, which facilitates attachment of the second strip-like element 42 to the first strip-like element 40; and a pair of distal offset portions 50 and 52; which define a spaced pair of bracket portions adapted to receive and support hose for storage.

Referring again to FIG. 2, the band member 32 provides a means for clamping the cylinder 12 securely within the apparatus 10. For this purpose, the band member 32 is made in the form of an open-ended (discontinuous) hoop, the open ends of which are interconnected by a manually operable toggle 54. Operation of the toggle 54 serves to tension to band member 32 around the cylinder 12, thus frictionally retaining the cylinder 12 in association with the band member 32 and the remainder of the support 14.

Referring now to FIGS. 1 and 5, the jacket 16 will now be described in detail. The jacket 16 provides a convenient and economical means for storing accessories which are used in association with the cylinder 12. In FIG. 5, the jacket 16 is depicted in flat form, out of association with the support 14. In FIG. 1, and also in FIGS. 3 and 4, the jacket 16 is seen in cooperative interengagement with the support 14.

Referring now to FIG. 5, the jacket 16, which may advantageously be fabricated from canvas or other suitably durable fabric, comprises a generally rectangular body portion 56, to which there are affixed, by stitching, riveting or the like, a number of pockets 58, 60 and 62 of various sizes and shapes. The sizes and shapes of the pockets 58, 60 and 62 are such that they can readily accommodate various accessories and pieces of equipment with which the cylinder 12 is ordinarily used. For example, the pocket 58 is a narrow elongated pocket, adapted to receive a welding torch. The pockets 60 and 62 are differently configured, and may hold wire brushes, abrasives, fluxes, and various fittings or other materials which may be useful to a user of the apparatus 10.

The pockets 58, 60 and 62 are disposed transversely with respect to the body portion 56 of the jacket 16, so that when the jacket 16 is operatively disposed, the pockets are vertically oriented, with openings at their upper ends. The pockets 58, 60 and 62 are advantageously provided with flaps, such as the illustrative flap 64. Fasteners 66, such as the multiple hook and eye type contact fastener sold under the trademark "Velcro", may be used to secure the flaps. In the preferred form of the jacket 16, a hem 67, best seen in FIGS. 3 and 5, receives and encloses the band member 32.

Referring again to FIG. 5, respective lateral edges of the body portion 56 of the jacket 16 are provided with slit portions 68 and 70, the spacing of which corresponds generally to the length of the portions 46 and 48 of the second strip-like element 42. Referring to FIGS. 1 and 4, it will be seen that the jacket 16, when operatively disposed, encircles the cylinder 12, and that the slit portions 68 and 70 facilitate fitting of the jacket 16 around and through the upright support member 28. The slit portions 68 and 70, in association with the various portions of the second strip-like element 42 serve to positively position the jacket 16 both axially and circumferentially with respect to the cylinder 12.

In order to permit operation of the toggle 54 when the jacket 16 is operatively disposed, the body portion 56 of the jacket 16 is provided with a cut-out opening or aperture 72. The opening 72 facilitates access to the toggle 54.

Respective lateral edges of the body portion 56 of the jacket 16 are provided with quick disconnect fasteners to facilitate removal of the jacket 16 from the support 14 when desired. These fasteners too, may be of the "Velcro" type, and are designated by the reference numerals 74 and 76.

The jacket 16 may be made red in color, to signify the presence of welding gas in the cylinder 12.

Referring now to FIG. 1, the manner in which the present apparatus may be used should now be apparent. Seen in FIG. 1, in association with the cylinder 12, is a regulator 78, to which there is affixed a hose 80. In FIG. 1, the hose 80 is shown disposed for storage about the offset portions 50 and 52 which define the bracket portions of the upright support member 28. The central offset portion 44 which defines the handle, is nevertheless readily accessible, to permit easy portability of the entire apparatus 10, including the cylinder 12. A torch 82 is affixed to the hose 80, but rests in the pocket 58 of the jacket 16, ready for removal at a job site. Portability of the apparatus 10 may be further enhanced by use of an adjustable shoulder strap 84, removably coupled to the above-mentioned bracket 24 associated with the base 20, and secured at its other end to the top of the cylinder 12.

The manner in which the present apparatus 10 provides a simple, efficient and easy to use supporting and transporting apparatus should now be apparent. The mechanically simple apparatus 10 provides a sturdy side handle for simple lifting, as well as a means for neatly wrapping a hose around a protective holder. The base 20 provides a stable support for the cylinder, preventing tipping, and the jacket 16, which provides for ready storage of accessories and equipment, is readily removable for washing or maintenance. The adjustable shoulder strap 84 permits hands-free carrying.

The principles of the apparatus may be adapted to any size cylinder, and this support 14 may be made from commonly available materials, such as one-eighth inch zinc plated steel bar and sheet stock. Fabrication may be by any suitable conventional means, such as spot or gas welding, riveting or the like, and the above-described construction provides a strong structure of relatively light weight, on the order of only about three pounds for a support for a "B" size cylinder.

It will be recognized that the present invention may be embodied in other specific forms without departing from its spirit or essential attributes. Accordingly, reference should be made to the appended claims rather than the foregoing specification as indicating the scope of the invention.

We claim:

1. An apparatus for supporting and transporting a gas cylinder or the like, a support having a base and cylinder retaining means coupled to said base and extending upwardly therefrom, said cylinder retaining means comprising an upright support member affixed to said base and cylinder-encircling means coupled to said upright support member, said cylinder encircling means having means thereon for encircling and clamping a cylinder when the apparatus is operatively disposed, and said upright support member comprising a handle portion for carrying the apparatus and bracket portions adapted to receive hose for storage, said upright support member comprising a first strip-like element affixed to said base, and said handle portion and said bracket portions comprising a second strip-like element affixed to said first strip-like element, said second strip-like element having a sinuous configuration which defines said handle and said bracket portions.

2. Apparatus in accordance with claim 1, wherein said cylinder-encircling means comprises a plurality of band members coupled to said upright support member at vertically spaced locations thereon, one of said band members being coupled to said upright support member remote from said base and another of said band members being coupled to said upright support member between said one band member and said base, and leg means extending between said one band member and said base, and leg means extending between and coupled to said another of said band members and said base.

3. Apparatus in accordance with claim 2, wherein one of said band members comprises an open-ended hoop, and toggle connectors interconnecting the open ends of the hoop to facilitate tensioning of said hoop.

4. Apparatus in accordance with claim 3, wherein said band members are coupled to said upright support member at locations disposed, respectively, on opposite sides of said handle portion.

5. Apparatus for supporting and transporting a gas cylinder or the like, comprising a support having a base, cylinder retaining means coupled to said base and extending upwardly therefrom, and equipment storage means selectively engageable with said cylinder retaining means and adapted to encircle the cylinder when the apparatus is operatively disposed, said equipment storage means comprising a jacket having a plurality of pockets therein for receiving welding tools and the like, said cylinder retaining means comprising an upright support member affixed to said base, and cylinder-encircling means coupled to said upright support member, said cylinder encircling means having means thereon for encircling and clamping a cylinder when the apparatus is operatively disposed, said upright support member comprising a handle portion for carrying the apparatus and bracket portions adapted to receive hose for storage, said upright support member comprising a first strip-like element affixed to said base, said handle portion and said bracket portions comprising a second strip-like element affixed to said first strip-like element, and said second strip-like element having a sinuous configuration which defines said handle and said bracket portions.

6. Apparatus for supporting and transporting a gas cylinder or the like, comprising a support having a base, cylinder retaining means coupled to said base, said cylinder retaining means extending upwardly from said base and comprising means for encircling and clamping a cylinder to the apparatus when the apparatus is operatively disposed, and equipment storage means selectively engageable with said cylinder retaining means and adapted to encircle the cylinder when the apparatus is operatively disposed, said equipment storage means comprising a jacket having a plurality of pockets therein for receiving welding tools and the like, said cylinder retaining means having a plurality of vertically spaced band members and a toggle connector on one of said band members for tensioning said band member, said jacket encircling the cylinder when the jacket is operatively disposed and having an opening therein to facilitate access to said toggle connector when said jacket is operatively disposed, and said cylinder retaining means comprising an upright support member comprising a first strip-like element affixed to said base and a second strip-like element coupled to said first strip-like element, said second strip-like element having a sinuous configuration which defines a handle portion and a spaced pair of bracket portions, said jacket having slit portions thereof to facilitate fitting of said jacket around said handle and said bracket portions.

7. Apparatus in accordance with claim 6, and quick disconnect fastener means disposed at respective lateral edges of said jacket to maintain said jacket in a cylinder-encircling disposition when the apparatus is operatively disposed.

* * * * *